United States Patent [19]

Cooke, Jr.

[11] Patent Number: 4,606,204

[45] Date of Patent: Aug. 19, 1986

[54] SYSTEM AND APPARATUS FOR OPENING CYLINDER LOCKS

[76] Inventor: Robert G. Cooke, Jr., Rte. 2, P.O. Box 29, Ahoskie, N.C. 27910

[21] Appl. No.: 565,403

[22] Filed: Dec. 27, 1983

[51] Int. Cl.[4] ..... B25D 11/00

[52] U.S. Cl. ..... 70/394; 81/15.9

[58] Field of Search ..... 70/394; 81/3; 33/174 F

[56] References Cited

U.S. PATENT DOCUMENTS 2,565,254 8/1951 Miskill ..... 70/394

3,264,908 8/1966 Moore ..... 81/3 R 4,156,375 5/1979 Crasmianski ..... 81/3 R

*Primary Examiner*—Robert L. Wolfe

*Attorney, Agent, or Firm*—Charles Edison Smith

[57] ABSTRACT

A lock opening method and mechanism for opening locks in minimum time while requiring very little skill on the part of the operator. The mechanism includes an adapter assembly, a tension arm and an oscillator unit. The assembly asserts rotary force to a lock cylindrical plug. This causes the lock pins to release and allowing the lock to be opened.

4 Claims, 16 Drawing Figures

FIG. 11.
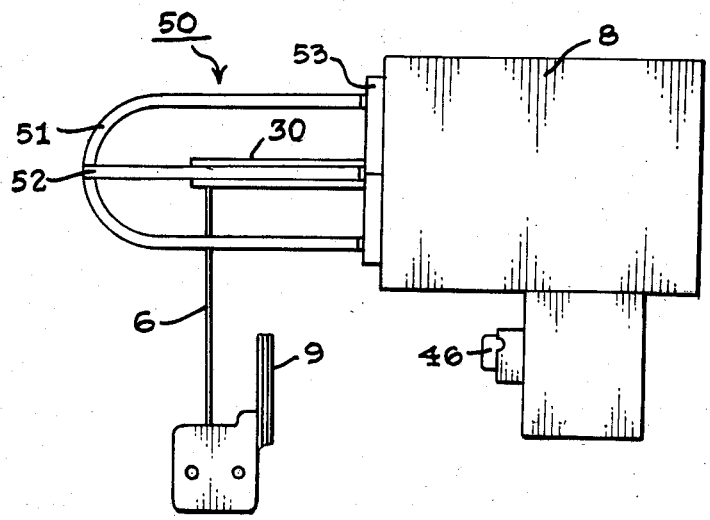
FIG. 13.
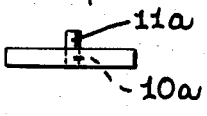
FIG. 12.
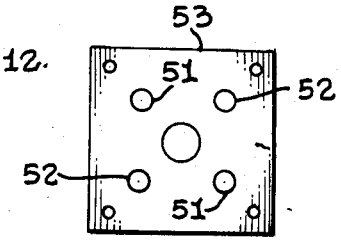
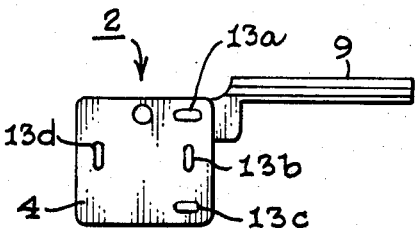
FIG. 2.
FIG. 3.
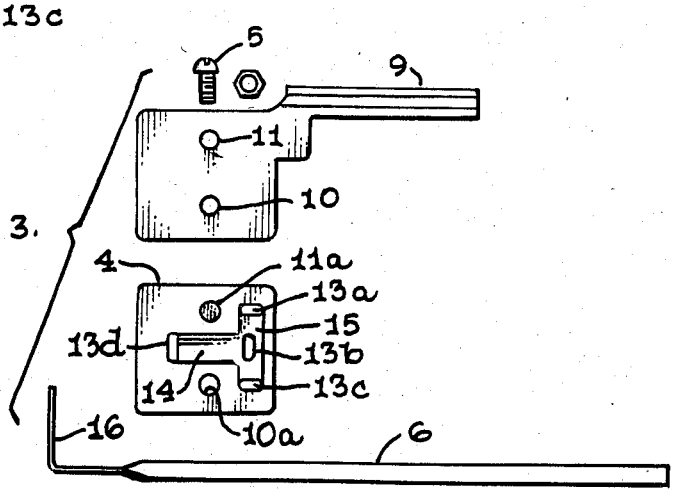

SYSTEM AND APPARATUS FOR OPENING CYLINDER LOCKS

BACKGROUND OF THE INVENTION

This invention relates to a method of opening a wide variety of modern locks in common use and a lock opening mechanism embodying the method. More specifically, this invention relates to a new and improved method and apparatus to facilitate the opening of a variety of security locks including disc tumbler, wafer tumbler and pin tumbler cylinder type locks when the key has either been lost or misplaced.

While it is the endeavor of lock craftsman to design pick proof locking devices, it is known among experts of the lock making industry that a key operated lock mechanism is subject to picking. However, it is not a simple task for the lock artist to design and construct an instrument to pick a real security lock. As a result of extensive laboratory research many present day locks, while not pickproof are pick resistant and will stubbornly resist attempts made to pick it. Consequently, lock picking itself has demanded a great deal of expert knowledge, skill and a considerable amount of study. Most typically, it is known how to pick pin tumbler cylinder locks by means of a device carrying a pick needle member with a trigger operated means for setting the needle, inserted into the keyway, into vibration in order to apply vibrations to the tumblers and counterpins. During this operation, a rotary force is applied to the lock cylinder. It has been found in practice that opening a lock with such a device requires skill and an inordinately large amount of time.

U.S. Pat. No. 4,156,375 to Crasnianski disclosed a lock pick mechanism comprising a motor driven cam in order to impart a shock motion to the pick needle member which is inserted into the lock keyway. The pick needle of the Crasnianski device is arranged on a member to be struck repeatedly by the end of a hammer to impart a shock or pulse to the pick needle. U.S. Pat. No. 3,264,908 to Moore also disclosed a vibratory lock device comprising an electro-magnetic motor which imparts a vibratory motion to the pick needle so that the lock may be opened by means of a turning wrench. U.S. Pat. No. 2,565,254 to Miskill discloses a power actuated lock pick which operates in a manner very similar to that disclosed in the Moore patent. The Miskill reference disclosed the use of continuous vibrational motion which is imparted to a lock pick blade. Miskill further disclosed a tension member which is adapted to be inserted into the keyway to a lock beneath the lock pick in order to hold the lock pick in the upper part of the keyway in a position for impact engagement with the lock tumbler pins.

SUMMARY OF THE INVENTION

It is an object of this invention to provide an improved method and apparatus to be used by the initiated lock craftsmen and law enforcement officials as an instrument for opening all standard makes of pin and wafer cylinder locks in a minimum of time. Many locks can be opened in a matter of seconds. It is also an object of the invention to provide a lock opening mechanism which can be conveniently, economically and rapidly assembled. Another object of this invention is to provide mechanism for enabling the lockmaster and law enforcement officials to open high grade locks while requiring very little, if any, skill on the part of the operator.

Still another object of this invention is to provide an oscillating mechanism which operates to rotate lock cylinders back and forth repeatedly in a very rapid movement to facilitate their opening.

Yet another object of this invention is to provide a lock pick mechanism to facilitate rapid opening of locks by means of an oscillating implement which imparts a rotary action to the lock cylinder, a spring arm or tension member and an adapter assembly. The adapter assembly is provided with a clamp and base constructed to be inserted into the keyway of the particular type lock to be opened. The adapter base is designed to provide a space between the base and the lock tumbler pins such that the operator can easily insert a lock pick into the keyway of the lock.

The foregoing objectives and other objectives are accomplished by using an oscillator unit to rotate the cylinder of a lock in a back and forth motion. The motion is transmitted to the cylinder through the adapter assembly base. The adapter base, which comes in different shapes depending upon the particular lock to be opened, is detachably mounted to the adapter clamp. Each adpater base is provided with two openings. One of the openings in the base is to facilitate a fastener screw. The adapter clamp is provided with a cylindrical stud positioned to fit into the other base opening. This hole and stud alignment resists twisting of the adapter clamp in relation to the adapter base. The adapter clamp is provided with a treaded hole to receive a standard screw-fastener means for holding the adapter base and clamp together in a snug or tight fit. The adapter clamp is provided with four slits or openings arranged to facilitate the insertion of the end of the spring steel arm through one of the slits. The adapter clamp is further provided with two grooves or recesses arranged at a right angle to each other to permit the end of the spring steel arm member to be passed through the slit to seat with one of the recesses such that the edges of the adapter clamp and base will be flush together when joined by the screw-fastener means. The two grooves are so arranged, and the slits are so positioned such that the tension or spring steel arm member can be turned in various positions at 90 degree intervals throughout 360 degrees. This allows the operator to position the oscillator unit in various positions to obtain the most optimum position to facilitate the opening of a lock. The free end of the tension or spring steel arm member is designed to be inserted into one of two slots or openings carried on the end of the oscillator unit rod. The slots are arranged at a right angle to each other to allow the spring steel arm member to be turned to obtain the most optimum position for the operator. The spring member is secured in the slot with a set screw provided on end of the oscillating rod.

Once the spring arm is secured between the adapter assembly and the oscillator unit, the lock opening device is completely assembled and ready for use. In one embodiment the adapter base of the adapter assembly is inserted in the lower or bottom portion of a lock cylinder plug of a particular lock to be opened. The adapter base selected for this particular lock fits snug in the keyway, thereby avoiding or reducing any lost motion between the spring arm member and the lock cylinder plug. This snug fit permits more efficient application of the oscillation force to the lock cylinder plug and results in less wear-and-tear damage to the adapter base.

It would be impractical to employ an ordinary key as an adapter base by cutting off its upper portion for at least two reasons. First, there would be so much play between the key base and the lock cylinder plug that a great deal of the oscillation force would be lost. Second, and more importantly, the key base would probably break after a few applications or within a short period of time.

The oscillator unit is pushed in the direction that you wish the lock cylinder to turn. This bends the adapter spring arm member slightly and puts a little pressure on the adapter assembly and the lock cylinder plug. When the lock opening mechanism is turned on with the switch. The oscillator unit rod moves back and forth causing the spring steel arm member to move back and forth. This causes the adaper assembly to move the lock cylinder plug back and forth rapidly. Thus, the adapter assembly asserts repeatedly, a rotary motion on the lock cylinder plug. Quick opening of the lock is made possible by inserting a lock pick to the rear of the lock cylinder plug and picking each pin up until all the pins have been picked upward. While holding this vibrating tension on the lock cylinder plug with the lock opening device, the operator gently turns the lock cylinder plug with the pick in the opposite direction from which the lock opening device is applying the most of its pressure. The upper pins will then vibrate down to the sheer line and the lock opening mechniasm will turn the cylinder open before the tumbler pins can pass the sheer line of the lock cylinder. The lock opening device oscillates its shaft very fast (approx. 3500 C.P.M.) and this causes the lock cylinder plug to grip the lock tumber pins many times and release them many times each minute. The tumbler pins are alternatively, in a stationary state and a movable state many times a minute. Therefore, they can be manipulated by the operator to open the lock with little difficulty. The lock opening device will operate when the tumbler pins are raked, picked or even pushed up all at once. Thus, the operator has a choice of ways to use the device.

The oscillator unit is driven by a small electric motor which has a current rating of less than four amps. This motor can be a standard motor, a two speed motor, a rechargeable power pack type motor or a variable speed motor. Also, the stroke of the oscillator unit rod can be changed by changing the position of the stud mounted on the driver gear and which carries a bushing that rides in a slot or bracket carried on the oscillator rod. The motor drives a small gear on the end of its shaft. This small gear drives a larger gear called the driver gear. This gives the motor more driving power. The driver gear has a small stud and bushing on it which fits into a slot on the oscillator shaft. Each time the motor makes a complete revolution the oscillator rod makes a complete cycle. As the driver gear turns round and round, the oscillator rod goes in and out. As the oscillator rod goes in and out, the spring steel arm or tension member asserts repeated the back and forth rotary pressure to the adapter assembly and lock cylinder plug. Also, some of the vibration from the oscillating spring steel arm member is directed to the lock tumbler pins causing the lock to cleave at the sheer line the tension of the lock opening device will cause the lock to open.

The lock opening device of this invention varies from the prior art in several important respects. In the past, instruments were made to strike the lock pins and force them up into the lock case. This damages the pins making them out of round and scared. They are left in a condition which is not proper for the best lock operation. In accordance with this invention, the adapter assembly base does not strike the pins in the lock. The base fits tight in the lock core, and therefore, it eliminates any undesired play between the adapter assembly and the lock core. To simply cut the top off of a key and use the bottom portion would not be feasible because the difference in tolerance would be so great that the key would soon break off. The adapter assembly of this invention fits tight, therefore, any play is removed and the adapter assembly is not apt to break off. Also, in the absence of play the device can impart more back and forth force to the lock cylinder plug. The lock opening device moves the lock cylinder plug back and forth very rapidly causing the lock tumbler pins to be suspended when moved by the lock pick or even by a straightened paper clip. The lock opening device of this invention will work with any small piece of strong metal which is of a sufficient size to allow it to move the lock tumbler pins freely. The operator can also use any standard lock pick for this purpose. The top tumbler pins of a lock can be pushed above the sheer line of the lock of the operator and then allowed to work themselves down to the sheer line when the lock cylinder plug is gently turned back away from the main tension pressure of the lock opening device. In this way, the tumbler pins are slowed down from movement yet, they are free to move downward as desired by gently removing some of the oscillating tension pressure. Because of the many tumbler pins in a lock cylinder, with prior lock opening devices, it was very difficult to get all the pins in the proper place because as they were forced upward, the recoil from the lock springs forced them back downward very rapidly. It took much patience to get them all in the proper position to open the lock. With the lock opening device of this invention, the pins tend to stay where placed better, and this makes the job of opening a lock easier and faster. In addition, the pins will not be damages as they might when struck by hard hammer blows from such instruments as lock pick guns and electric driven picks. The lock opening device of this invention achieves its objectives by moving the lock plug back and forth very rapidly using a spring steel arm member attached to the adapter assembly on one end and the oscillator unit rod on the other end. As the rod moves in and out the spring steel arm moves the adapter assembly and the lock plug back and forth. The lock tumbler pins are free to be moved, yet they tend to be held in place long enough for the lock to be opened. In this process, lock opening device does not touch the tumbler pins of the lock with any of its parts. The adapter assembly is wedged into the bottom of the lock core and cannot touch the lock tumbler pins. The lock pick is the only instrument which actually comes into contact with the lock tumbler pins. Thus, manipulation of the pins by the operator can be done in a gentle way.

BRIEF DESCRIPTION OF THE DRAWINGS

The foregoing objectives and other objects and advantages of this invention will become apparent to those skilled in the art after reading the following description taken in conjunction with the accompanying drawings wherein:

FIG. 2 is a side elevational view of the adapter assembly portion of the lock opening system;

FIG. 3 is a side elevational view of the disassembled adapter assembly portion of the lock opening system;

FIG. 11 is a side elevational view of the guard assembly portion of the lock opening system.

FIG. 12 is a front view of a portion of the guard guard assembly of FIG. 11.

FIG. 13 is a front view of the adapter assembly.

DESCRIPTION OF THE PREFERRED EMBODIMENT

The invention herein is described and illustrated in a specific embodiment having specific components listed for carrying out the functions of the appartus. Nevertheless, the invention need not be thought of as being confined to such a specific showing and should be construed broadly within the scope of the claims. Any and all equivalent structures known to those skilled in the art can be substituted for specific appartus disclosed as long as the substituted apparatus achieves a similar function. It may be that systems other than lock opening systems have been, or will be invented wherein the apparatus described and claimed herein can be advantageously employed, and such other uses are intended to be encompassed in this invention as described and claimed herein.

Figure 1:
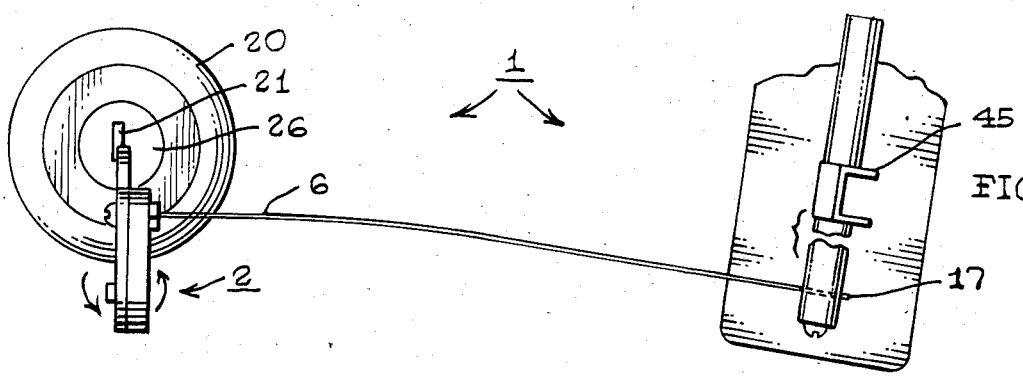
FIG. 1 is a primarily side elevational view of the lock opening system according to the present invention.
Figure 10:
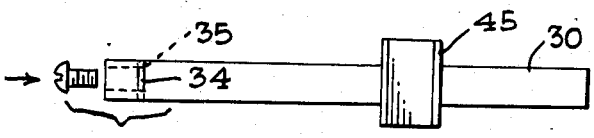
FIG. 10 is a side elevational view of the oscillator rod portion of the lock opening system.
Figure 10A:
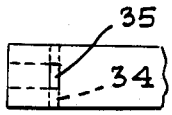
FIG. 10*a* is a detail sectional view through FIG. 1 on the plane of the line 10*a*—10*a*.
Figure 1A:
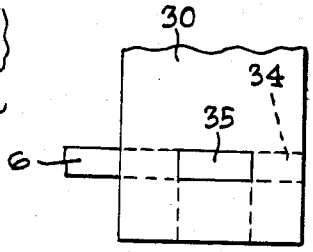
FIG. 1*a* is a detail sectional new through FIG. 1 on the plane of the line 1*a*—1*a;*
Figure 9:
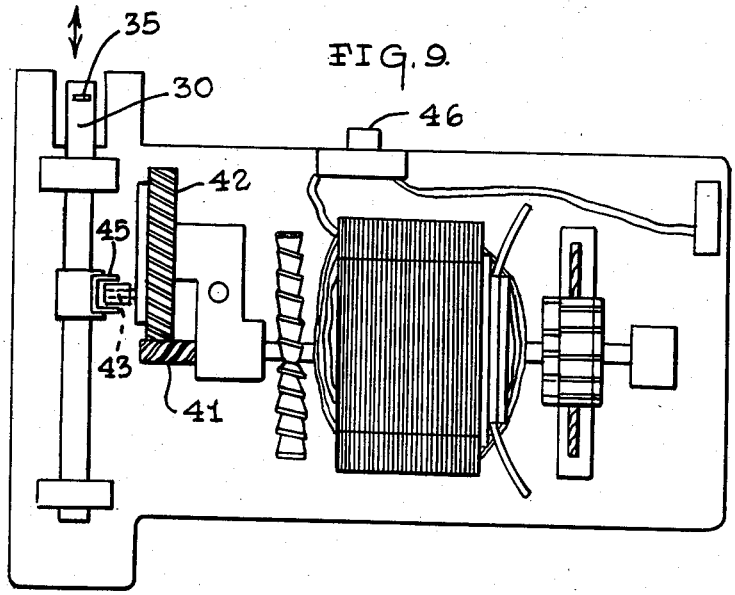
FIG. 9 is a top view of the oscillator portion of the lock opening system.
Figure 9A:
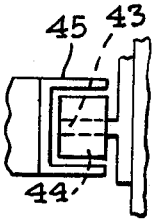
FIG. 9*a* is a detail sectional view through FIG. 9 on the plane of the line 9*a*—9*a*.

Reference is made to FIGS. 1, 2 and 3 in which various system components are illustrated. The lock opening mechanism, generally denoted 1, includes the adapter assembly 2, the spring steel arm or tension member 6 and the oscillator unit 7. The adapter assembly is comprised of three major components: the screw-fastener means 5 secures the assembly section together; the adapter clamp 4, which has a tapped or threaded hole 10*a* to receive the screw-fastener means 5; and the adapter base 3, which is form fitted and interchangeable depending upon the particular keyway of the lock to be opened. The adapter base 3 is designed to provide a different base finger 9 shape for the various types of lock keyways in common use. Each base finger 9 is designed and constructed such that the member does not come into contact with the lock tumbler pins of the lock being opened. The base finger 9 is also designed such that there is sufficient space between the base finger 9 and the lock tumbler pins to permit easy insertion of a lock pick.

The adapter base 3 is provided with two holes or openings. The hole 10 is arranged to receive the screw-fastner 5 and opening 11 to receive the pin or steel 11*a* formed on the wall of the adapter clamp 4. The stud 11*a* extends into the opening 11 in the adapter basee 3. The adapter clamp 4 is held very close to the adapter base 3 by screw-fastner 5 to prevent relative twisting motion during use of the lock opening device. The adapter clamp 4 is provided with four slit openings 13*a*, 13*b*, 13*c* and 13*d* for insertion of one end 16 of the arm member 6 through the clamp into one of the grooves 14 or 15. When the end 16 of the arm 6 is placed through one of the slit openings 13*a*–*d* into either groove 14 or 15, the edges of the adapter base 3 and adapter clamp 4 will be flush together when secured together by the screw-fastener 5. The tension arm 6 can be selectively positioned in varous directions depending upon which of the slits 13*a*–*d* is selected for installation of end 16, and also which of the grooves 14 or 15 is selected. Hence, this allows positioning the oscillator unit 7, carried in casing or housing 8, in a variety of positions to obtain the most optimum position for each application. The opposite end 17 of the tension member 6 is inserted into the opening or slot 34 in the oscillating rod 30, and is held secure by set screw 32. Once the ends 16 and 17 of arm 6 are attached through a slit 13*a*–*d* into the adapter assembly and to the oscillator rod 30, the lock opening system 1 is completely assembled and ready for use.

Figure 8:
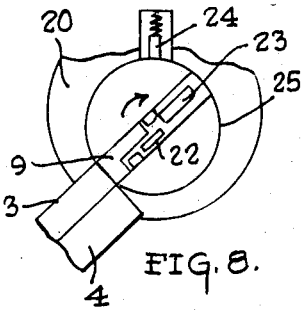
FIGS. 4 through 8 are side elevation sectional views of the lock opening mechanism in various stages of opening a lock.
Figure 4:
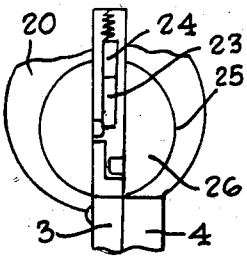
Figure 5:
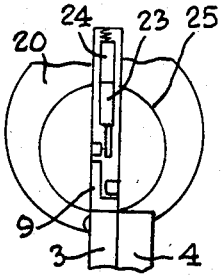
Figure 6:
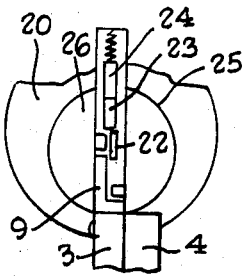
Figure 7:
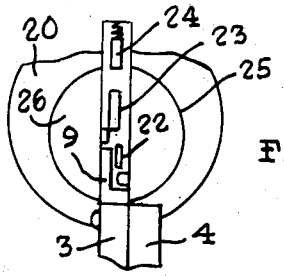

Referring now to FIGS. 4 through 8, the finger 9 of the adapter assembly 3 is shown inserted into the bottom portion of the lock cylinder 20 and plug 26. When the lock opening device is turned on, the oscillator unit rod moves the arm member 6 back and forth. This vibration force causes the adapter assembly 3, through base finger 9 to assert a rotary force on the lock cylinder plug 20. As shown in FIG. 5, lock pin 22 is inserted to the rear of the lock plug 26, and all of the lower lock tumbler pins 23 can easily be picked upward. Referring now to FIGS. 6–8, upper tumbler pins 24 will vibrate down to the sheer line 25, and the lock opening device will turn the lock open before the tumbler pins 24 can pass sheer line 25, and as shown in FIG. 8.

Referring now to FIGS. 9, 9*a*, 10 and 10*a*, the lock opening device is powered by a small electric motor 40 which has a switch 46 and a current rating of less than 4 amperes. Motor 40 can be a standard motor, a two speed motor, a variable speed motor, or even a rechargeable portable power pack type motor. The motor 40 drives gear 41 which drives a larger driver gear 42. Driver gear 42 has a stud 43 and bearing or bushing 44. The bushing 44 rides in a bracket or slot 45 contained on the oscillator rod 30. The speed of the motor can be varied by changing or adjusting switch 46. Also, the stroke of the oscillator rod 30 can be varied by changing the position of the stud 43, which is mounted on the driver gear 42 and which carries the bushing 44. Each time the motor makes a complete revolution the oscillator rod 30 also completes a cycle or revolution. As the driver gear 42 turns about its axis, the oscillator rod 30 moves back and forth or inward and outward. Since the rod 30 is attached to the arm member 6, as the rod 30 moves back and forth, the spring steel arm 6 causes rotary and vibrational forces to be applied through the adapter assembly to a lock cylindrical plug 26.

Referring to FIGS. 11 and 12, the lock opening mechanism includes a safety guard 50. The guard 50 comprises rods 51 and 52 and base plate 53. The guard 50 is mounted on the lock opening mechanism casing 8 to provide protection for the oscillator rod 30 which is driven back and forth by the driver gear 44.

Other modifications to the above described invention will be apparent to those skilled in the art, and are intended to be incorporated herein.

Having particularly described and ascertained the nature of the lock opening system, and the manner in which the same is to be performed, what is claimed is:

1. A lock opening device for unlocking various types of pin cylinder locks comprising:

a. A flexible spring arm member;
b. an adapter assembly having
(i) a base member provided with a finger extension having essentially straight, flat top and bottom surfaces extending substantiall parallel to each other
(ii) a clamp member
(iii) fastener means for detachably mounting one end of said flexible spring arm member between said clamp member and said base member; and
c. an oscillator unit having:
(i) a rotary shaft member for providing a rotary force to said flexible spring arm member, said shaft member provided with detachable fastener means for securing one end of said flexible spring arm member to said shaft member
(ii) varible driver means for driving said shaft member at varibles speeds and in a back and forth motion to thereby impart a rotary force through said flexible spring arm member to said finger extension and causing rotary forces to be applied to a lock plug facilating the opening of the lock without mechanical impact to tumbler pins.

2. In a lock opening device according to claim 1 wherein said finger extension top surface is designed to be spaced out of contact with tumbler pins when inserted into a lock keyway.

3. In a lock opening device according to claim 2 wherein said clamp member comprises multiple slit openings arranged in grooves to permit installation of one end of said flexible spring arm at the desired angle.

4. In a lock opening device according to claim 3 wherein said grooves are disposed to form a right angle within said clamp member.

* * * * *